US007161458B2

(12) United States Patent
Jang et al.

(10) Patent No.: US 7,161,458 B2
(45) Date of Patent: Jan. 9, 2007

(54) ELECTROMAGNETIC DEVICE HAVING INDEPENDENT INDUCTIVE COMPONENTS

(75) Inventors: Yungtaek Jang, Cary, NC (US); Milan Jovanović, Cary, NC (US)

(73) Assignee: Delta Electronics, Inc., Taipei (TW)

( * ) Notice: Subject to any disclaimer, the term of this patent is extended or adjusted under 35 U.S.C. 154(b) by 55 days.

(21) Appl. No.: 11/062,446

(22) Filed: Feb. 22, 2005

(65) Prior Publication Data

US 2006/0186981 A1 Aug. 24, 2006

(51) Int. Cl.
*H01F 27/28* (2006.01)

(52) U.S. Cl. ..... 336/220; 336/221; 323/335

(58) Field of Classification Search ..... 336/212, 336/220–222; 323/335, 338
See application file for complete search history.

(56) References Cited

U.S. PATENT DOCUMENTS 4,118,597 A * 10/1978 Proctor et al. ..... 379/378
4,274,051 A * 6/1981 Condon ..... 324/117 R
4,853,611 A * 8/1989 Kislovski ..... 323/335
5,789,907 A * 8/1998 Casagrande ..... 323/335

OTHER PUBLICATIONS

Y. Jang and R. W. Erickson, "New Quasi-Square Wave and Multi-Resonant Integrated Magnetic Zero Voltage Switching Converters," *IEEE Power Electronics Specialists Conf.* (*PESC*) *Proc.*, pp. 721-727, 1993.

. A. Pietkiewicz and D. Tollik, "Coupled-Inductor Current-Doubler Topology in Phase-Shifted Full-Bridge Dc—Dc Converter," *IEEE Applied Power Electronics Conf.* (*APEC*) *Proc.*, pp. 273-279, 2001.

. P.L. Wong, Q. Wu, P.X. Xu, B. Yang, and F.C. Lee, "Investigating Coupling Inductors in the Interleaving QSW VRM," *IEEE Applied Power Electronics Conf.* (*APEC*) *Proc.*, pp. 973-978, 2000.

I.D. Jitaru, "High Efficiency Flyback Converter Using Synchronous Rectification," *IEEE Applied Power Electronics Conf.* (*APEC*) *Proc.*, pp. 867-871, 2002.

* cited by examiner

*Primary Examiner*—Anh Mai
(74) *Attorney, Agent, or Firm*—Venable LLP; Robert S. Babayi

(57) ABSTRACT

A multi-port electromagnetic device comprises a first magnetic core having a first closed flux path and a second magnetic core having a second closed flux path, with the first closed flux path being independent from the second closed flux path. At least one first winding electromagnetically couples the first magnetic core to the second magnetic core, and at least one second winding electromagnetically couples the first magnetic core to the second magnetic core independent of the electromagnetic coupling of the at least one first winding such that current application in one of the first or second windings does not induce a magnetic flux in the other one of the first or second windings.

4 Claims, 28 Drawing Sheets

ELECTROMAGNETIC DEVICE HAVING INDEPENDENT INDUCTIVE COMPONENTS

BACKGROUND OF THE INVENTION

1. Field of the Invention

This invention relates to electromagnetic devices and, more particularly, to electromagnetic devices having independently coupled inductive components, such as inductors or transformers.

2. Description of the Prior Art

Electromagnetic devices have been used in a wide variety of applications, such as power supplies, etc. These devices generally comprise a magnetic core and one or more windings. Some power supplies use multiple electromagnetic devices at various stages of their power conversion circuitry. Conventionally, the magnetic cores of multiple electromagnetic devices has been integrated to increase the power density and decrease the component count of some power supplies. For example, known power conversion circuitry have used an integrated magnetic core to achieve magnetic coupling between two filter inductors. An integrated magnetic core is also used for magnetically coupling a filter inductor and a resonant inductor in switching power supplies. In these known approaches, however, the voltage waveforms across the magnetically coupled inductors are proportional to each other.

In some applications, it is desired that the voltage waveforms across the windings not to be proportional. FIG. 1 shows a known multi-port electromagnetic device that couples two windings in this manner. However, under this arrangement, one winding of the multi-port electromagnetic device of FIG. 1 is significantly influenced by the applied voltage across the other winding. In other words, the two windings of the multi-port electromagnetic device of FIG. 1 are dependent on each other because of their mutual inductance.

In some applications, it is necessary to provide a multi-port electromagnetic device having independent windings, for example, in power supplies that have multiple converter stages, where the inductive components in various stages should be independent of each other. This requirement makes the multi-port electromagnetic device of FIG. 1 unsuitable for such power supplies because of its dependent inductive components.

FIG. 2 shown another known multi-port electromagnetic device that uses a pair of E-shaped magnetic cores with symmetrical and asymmetrical windings to provide independent inductive components. However, in the multi-port electromagnetic device of FIG. 2, the reluctances of the two outer legs of the E core must be identical. Otherwise, if the reluctances of the two outer legs of the E-shaped cores are different from each other, the magnetic flux generated by the winding on the middle leg is not equally distributed to the outer legs. Consequently, the induced voltage across the windings of the outer legs are significantly influenced by the voltage across the winding on the inner leg, which causes the two windings not to be magnetically independent of each other.

Therefore, there exists a need for a compact multi-port electromagnetic device that has windings that are inductively independent of each other.

SUMMARY OF THE INVENTION

Briefly, according to the present invention, a multi-port electromagnetic device comprises a first magnetic core having a first closed flux path and a second magnetic core having a second closed flux path, with the first closed flux path being independent of the second closed flux path. At least one first winding electromagnetically couples the first magnetic core to the second magnetic core. Similarly, at least one second winding electromagnetically couples the first magnetic core to the second magnetic core. The electromagnetic coupling of the first and second windings are independent such that application of current in one windings does not induce a current in the other. Preferably, the winding directions of the first and second windings on one of the first or second magnetic cores are the same, however, the winding direction of the first and second windings on the other magnetic core are in opposite direction.

According to some of the more detailed features of the present invention, the first winding electromagnetically couples the first magnetic core to the second magnetic core serially, and similarly, the second winding electromagnetically couples the first magnetic core to the second magnetic core serially. In an alternative embodiment, the first winding electromagnetically couples the first magnetic core to the second magnetic core serially, but the second winding electromagnetically couples the first magnetic core to the second magnetic core in parallel.

According to other more detailed features of the present invention, the multi-port electromagnetic device further includes at least one third winding that electromagnetically couples the first magnetic core to the second magnetic core, thereby creating an inductor and a transformer arrangement. In addition, the multi-port electromagnetic devices could include at least one fourth winding. Under this arrangement, the third winding is electromagnetically coupled to the first winding, and the fourth winding is electromagnetically coupled to the second winding, thereby creating two transformer arrangements.

The first and second magnetic cores could have the same or different shapes. In an exemplary embedment, at least one of the first magnetic core and second magnetic core comprise toroidal magnetic core.

DETAILED DESCRIPTION OF THE INVENTION

The present invention relates to various embodiments of multi-port electromagnetic devices that have two groups of windings with each group comprising one or more serially- or parallel-coupled windings, as further describe below. Each group of windings stores decoupled magnetic energy in first and second magnetic cores such that the two groups of windings are magnetically independent of each other. For example, in order to obtain two independent inductors, a single winding from each group is required. However, for two independent multiple-winding transformers, multiple windings from each group are used.

In one exemplary embodiment, substantially one half of the winding turns are wound on the first magnetic core and the other half is wound on the second core for every winding in the two groups. In addition, as explained further below, winding directions on the first core for the two groups are the same, while winding directions on the second core for the two groups are opposite each other.

Figure 1:
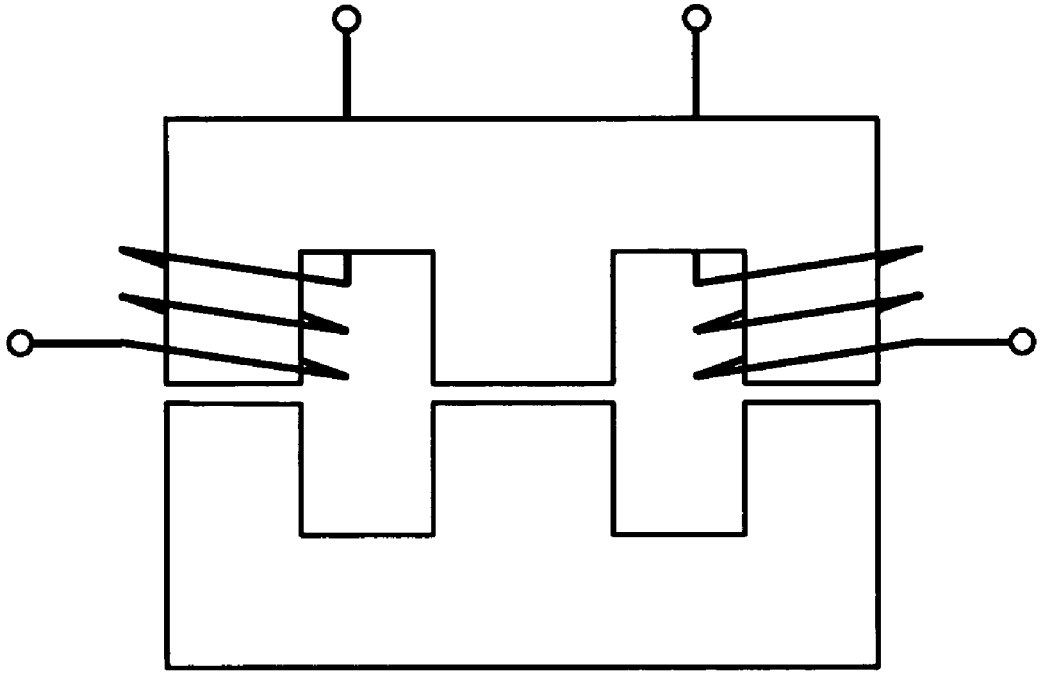
(PRIOR ART) Fig. 1
FIG. 1 shows a prior art multi-port electromagnetic device.
Figure 2:
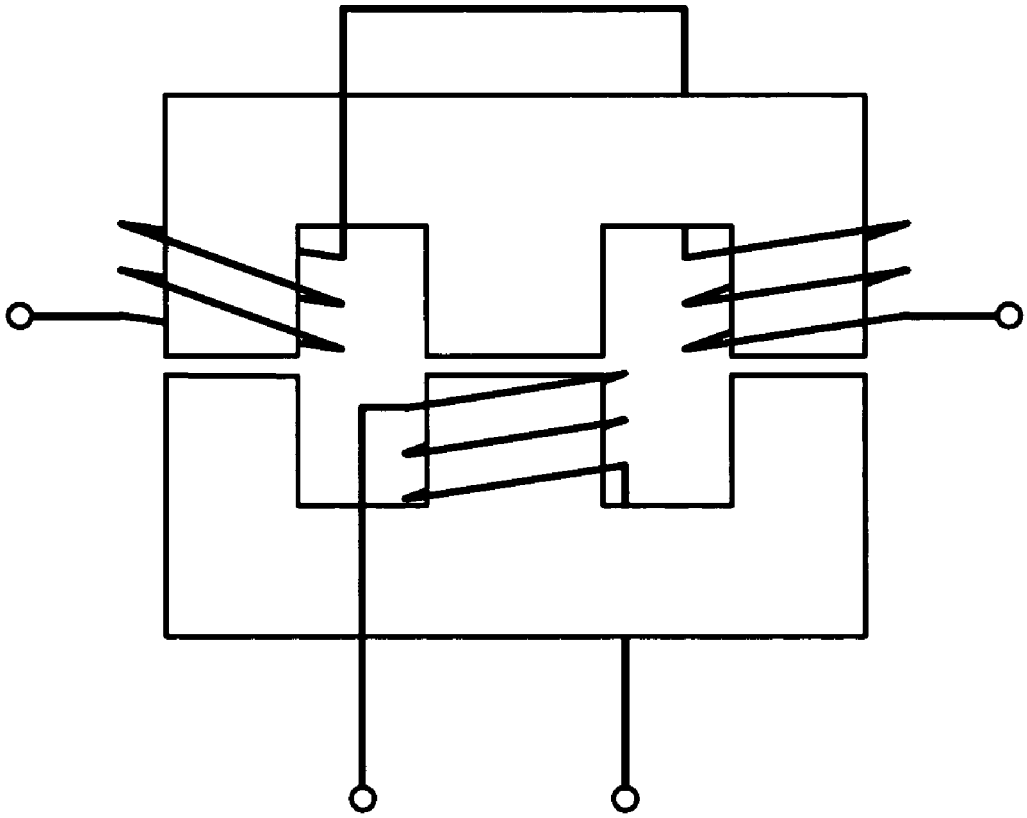
(PRIOR ART) Fig. 2
FIG. 2 shows another prior art multi-port electromagnetic device.
Figure 3:
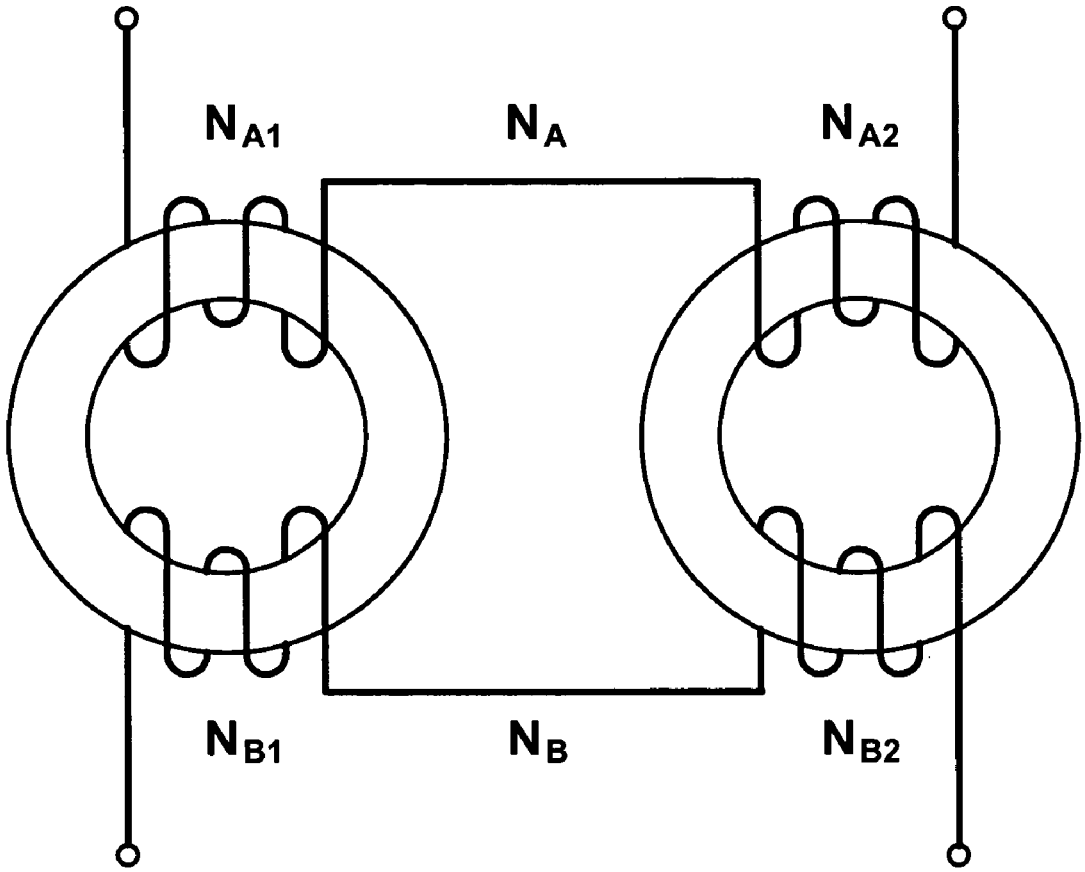
FIG. 3 shows a multi-port electromagnetic device having two serially coupled windings according to one embodiment of the invention.

FIG. 3 shows an exemplary embodiment of the multi-port electromagnetic device of the present invention. As shown, the multi-port electromagnetic device of FIG. 3 comprises two magnetic cores, i.e., a first magnetic core and a second magnetic core, and two windings, i.e., a first winding and a second winding. The first and second magnetic cores each have their respective first and second closed flux paths, which are independent of each other. In other words, flux path in one magnetic core does not influence flux path in the other magnetic core. According to the embodiment of FIG. 3, the first winding $N_A$ comprises two serial windings $N_{A1}$ and $N_{A2}$. The second winding $N_B$ also comprises serial windings $N_{B1}$ and $N_{B2}$. As can be seen, the serial windings $N_{A1}$ and $N_{B1}$ are wound on the first core such that they are in the same directions, however, the serial windings $N_{A2}$ and $N_{B2}$ are wound on the second core such that they have opposite directions relative to each other.

Figure 4:
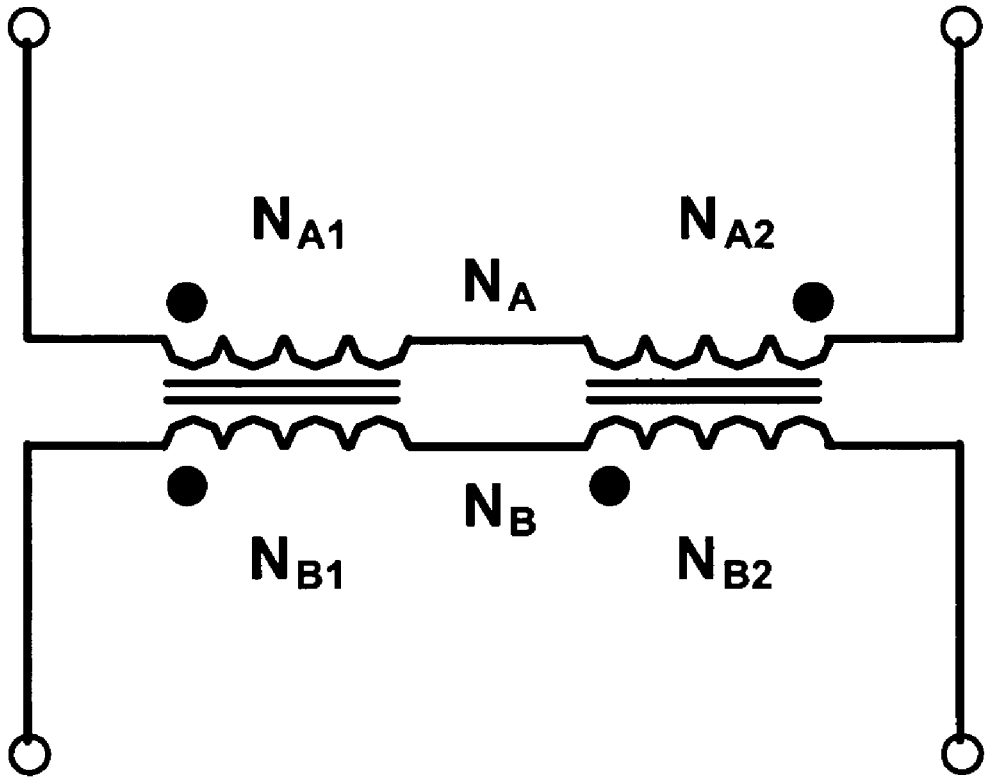
FIG. 4 shows a simplified symbol of the multi-port electromagnetic device of FIG. 3.
Figure 5:
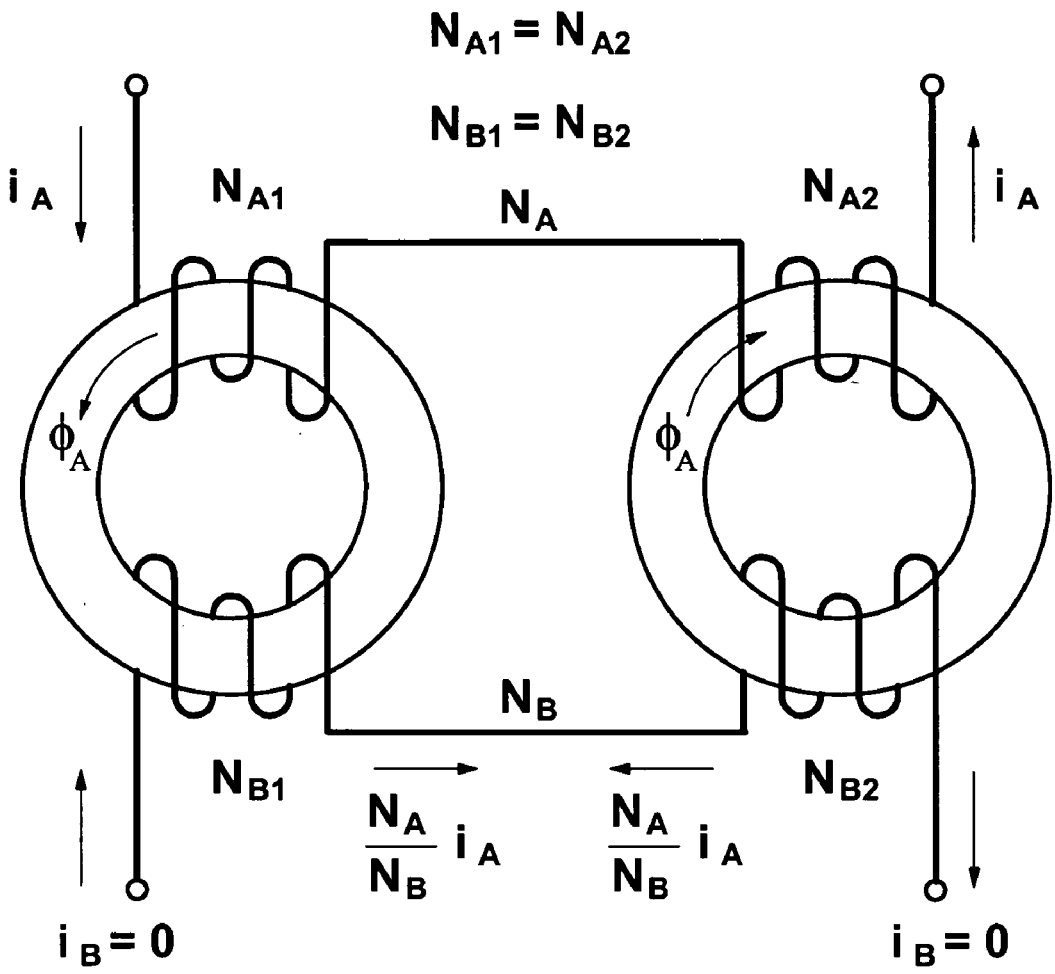
FIG. 5 shows the multi-port electromagnetic device of FIG. 3 with one reference directions for current and magnetic flux.

To facilitate the explanation, FIG. 4 shows the simplified symbol of the multi-port electromagnetic device of FIG. 3 with polarity marks for each winding. Moreover, FIG. 5 shows the multi-port electromagnetic device of FIG. 3 with reference directions of currents and the closed magnetic flux $\phi_A$, where current $i_A$ flowing through the windings $N_{A1}$ and $N_{A2}$. Preferably, the serial windings $N_{A1}$ and $N_{A2}$ have an equal number of turns, i.e., $N_{A1}=N_{A2}$, and the serial windings $N_{B1}$ and $N_{B2}$ also have an equal number of turns, i.e., $N_{B1}=N_{B2}$. As can be seen in FIG. 5, current $i_A$ generates the closed magnetic flux $\phi_A=N_A \times i_A$ in each core. Flux $\phi_A$ induces the current $i_B$ in windings $N_{B1}$ and $N_{B2}$ in core. Because of the opposite winding directions and the equal number of turns, the induced currents in the serial windings $N_{B1}$ and $N_{B2}$ have opposite directions and equal magnitudes, which result in cancellation of the induced currents. This makes the total current flowing though the windings $N_{B1}$ and $N_{B2}$ equal to zero, i.e., $i_B=0$. Thus, the application of any current in the first winding $N_A$ does not induce any current in the second winding $N_B$.

Figure 6:
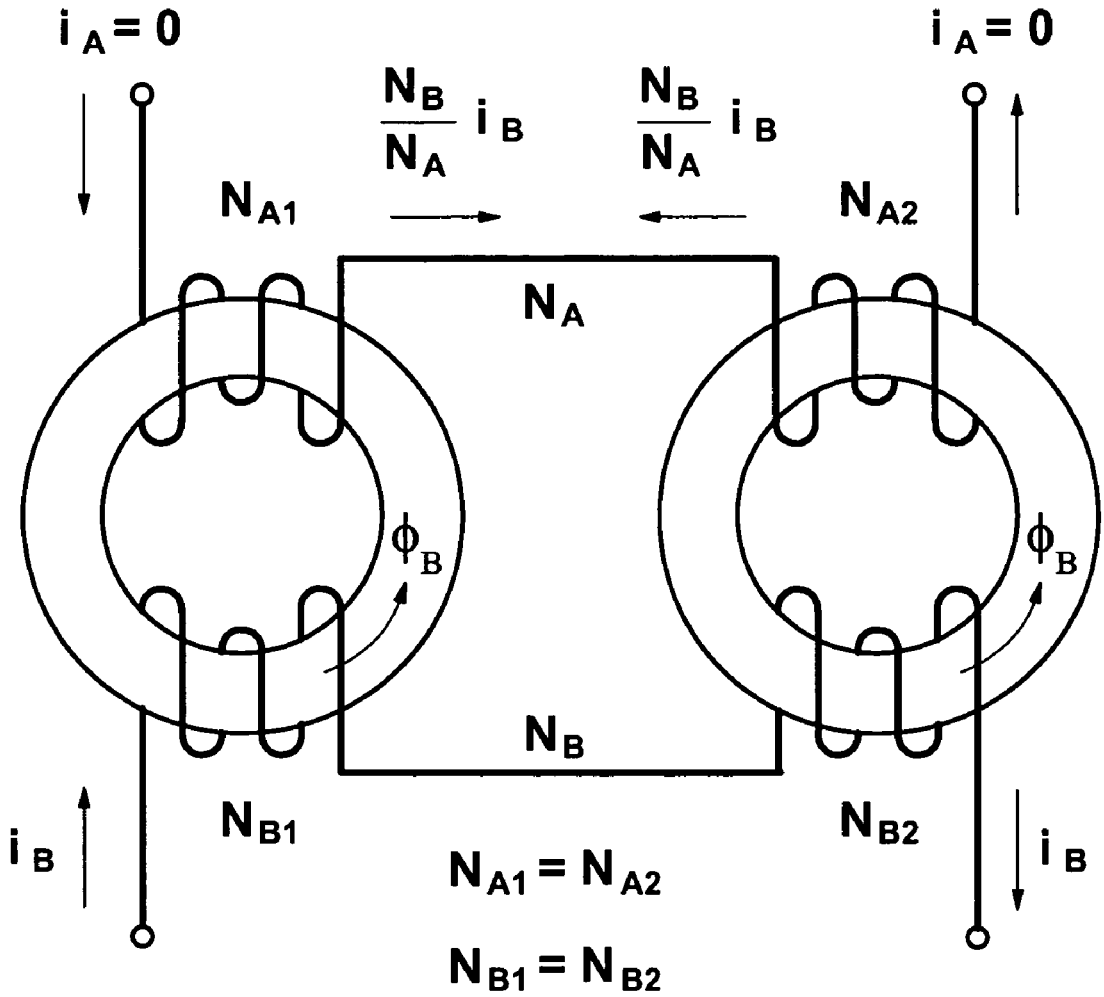
FIG. 6 shows the multi-port electromagnetic device of FIG. 3 with another reference directions for current and magnetic flux.

FIG. 6 shows the multi-port electromagnetic device of FIG. 3 with reference directions of currents and magnetic fluxes when current $i_B$ flows through the second serial windings $N_{B1}$ and $N_{B2}$. Current $i_B$ generates magnetic flux $\phi_B=N_B \times i_B$ in the first and second magnetic cores. Flux $\phi_B$ induces a current in the serial windings $N_{A1}$ and $N_{A2}$ in each of the first and second magnet cores. Because of the opposite winding directions and the equal number of turns, however, the induced currents in the serial windings $N_{A1}$ and $N_{A2}$ cancel each other out, causing the current flow therein to be zero, i.e., $i_A=0$. Moreover, induced voltage $V_{NA}$ across the first winding $N_A$ is not influenced by current $i_B$ in the second winding $N_B$, because voltage $V_{NA}$ is proportional to the varying rate of current $i_A$, which is zero. Thus, the application of any current in the second winding $N_B$ does not induce any current in the first winding $N_A$. Accordingly, the present invention makes the first winding and the second windings $N_A$ and $N_B$ magnetically independent of each other. In an exemplary application, the multi-port electromagnetic device of FIG. 3 can be used to provide two independent inductive components in different stages of a power supply. It should be noted, however, that the application of the electromagnetic device of the present invention is not limited to power supplies. In fact, the present invention can be used in any application that requires independent inductive components.

Figure 7:
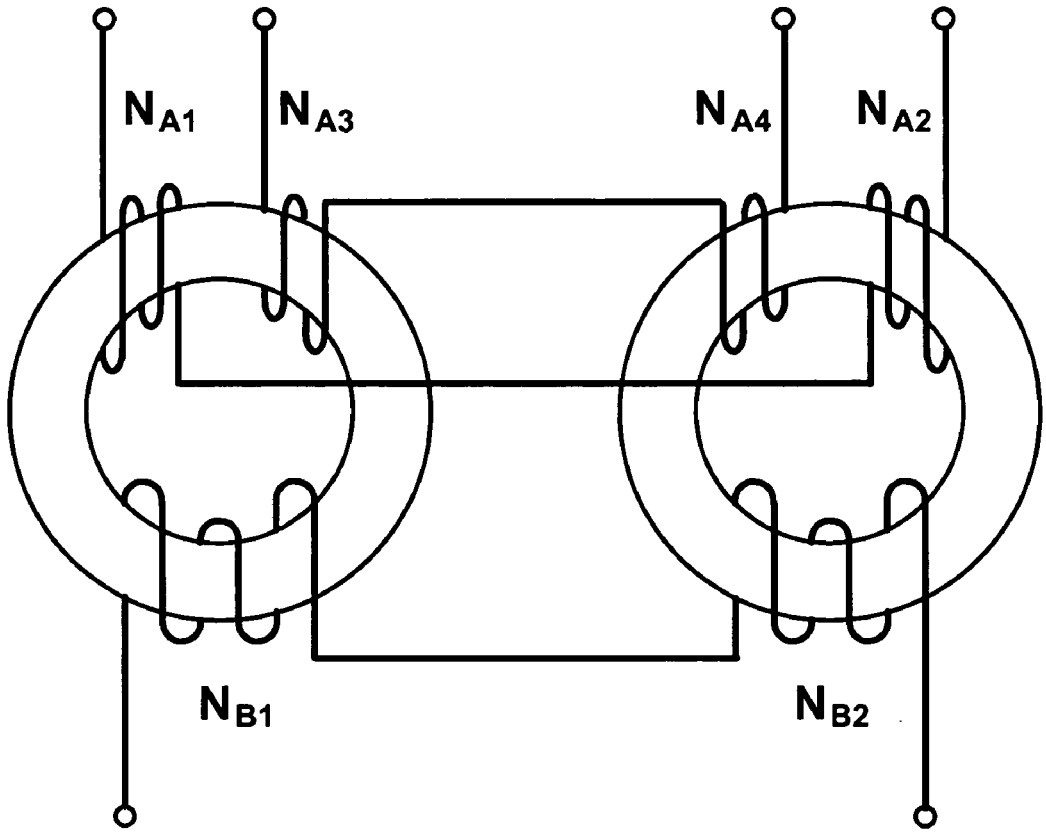
FIG. 7 shows a multi-port electromagnetic device having three serially coupled windings according to the present invention.
Figure 8:
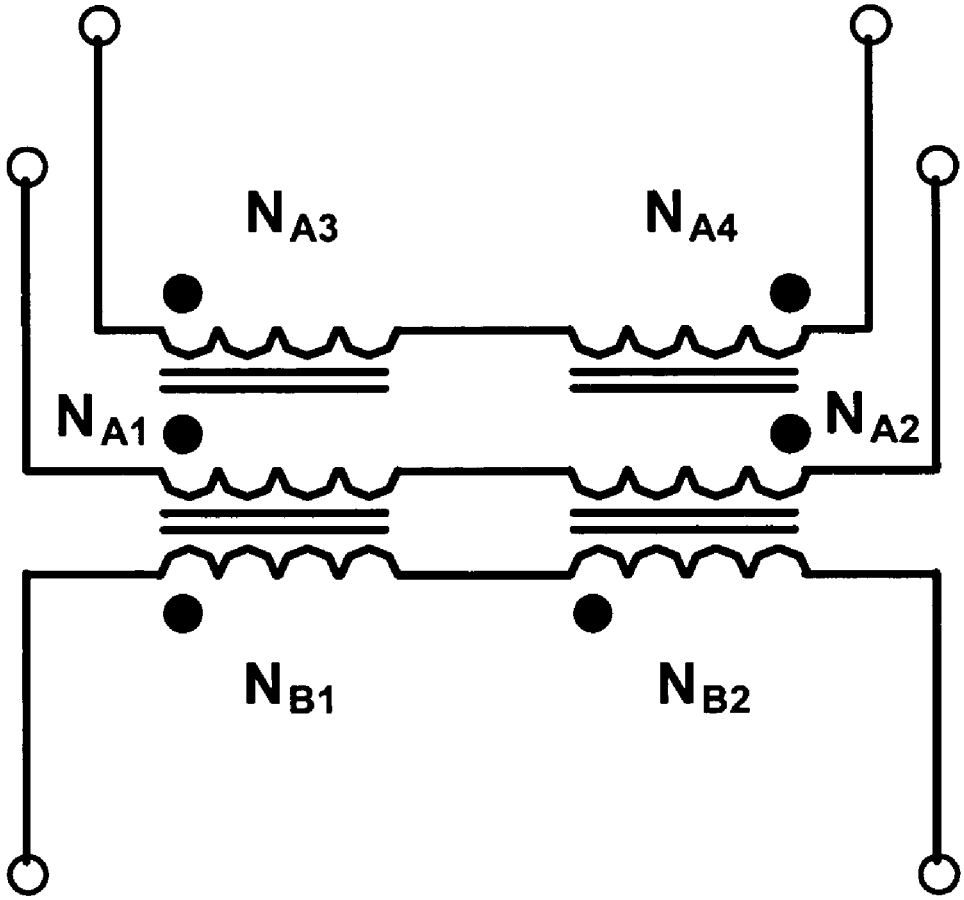
FIG. 8 shows the simplified symbol of the multi-port electromagnetic device of FIG. 7.
Figure 9:
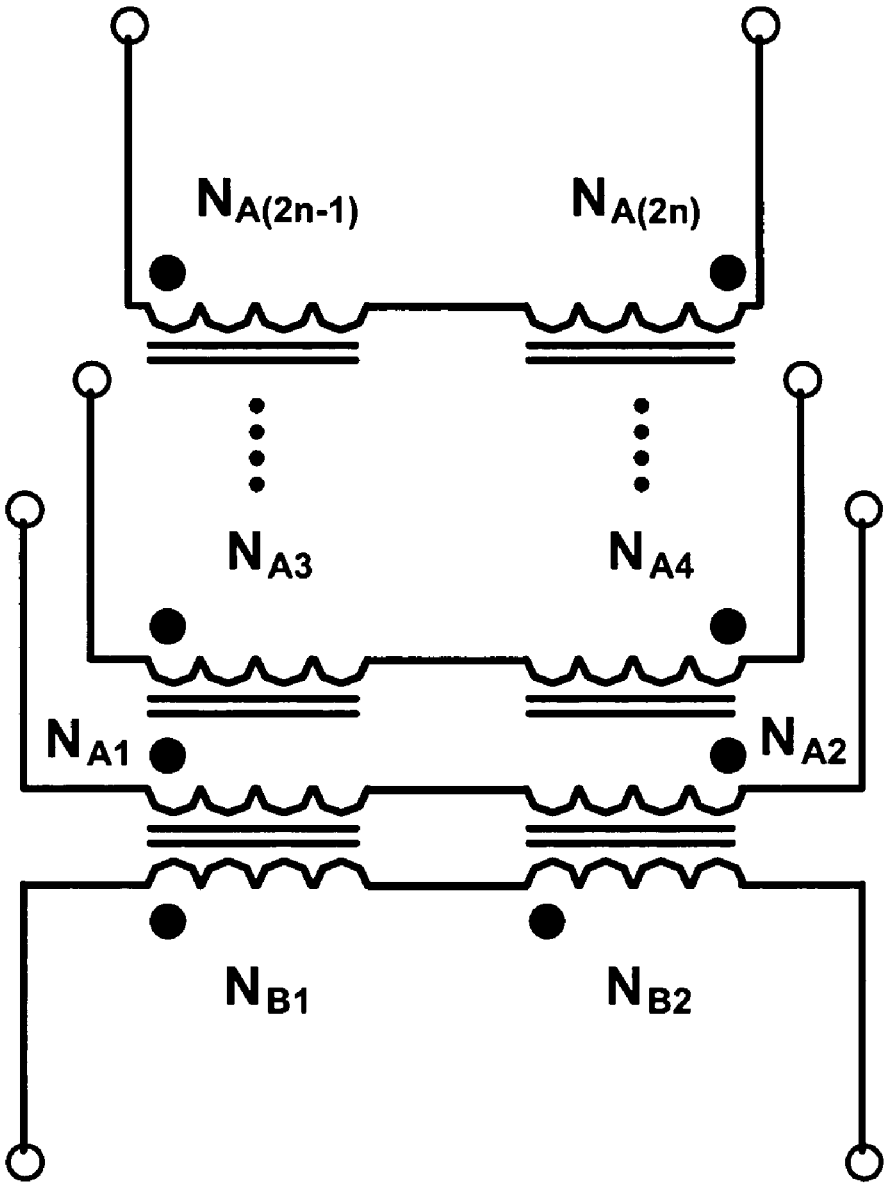
FIG. 9 shows the simplified symbol of the multi-port electromagnetic device according to an embodiment having n+1 serially coupled windings.

FIG. 7 shows a multi-port electromagnetic device having three windings according to the present invention. FIG. 8 shows the simplified symbol of the multi-port electromagnetic device of FIG. 7. The first winding, which consists of serial windings $N_{A1}$ and $N_{A2}$, and the second winding, which consists of serial windings $N_{A3}$ and $N_{A4}$, form a first group of windings. The third winding, which consists of serial windings $N_{B1}$ and $N_{B2}$, forms a second group of windings by itself. Under this arrangement, the first and second windings in the first group function as a two-winding transformer, while the third winding functions as an inductor that is independent of the transformer. FIG. 9 shows the simplified symbol of a multi-port electromagnetic device according to the present invention having n+1 serial windings, where n can be any integer. Because of the above-described property of the dual-port electromagnetic device of the invention, the devices of FIG. 7 or FIG. 9 provides windings that are suitable for use applications that require independent inductor/transformer arrangements.

Figure 10:
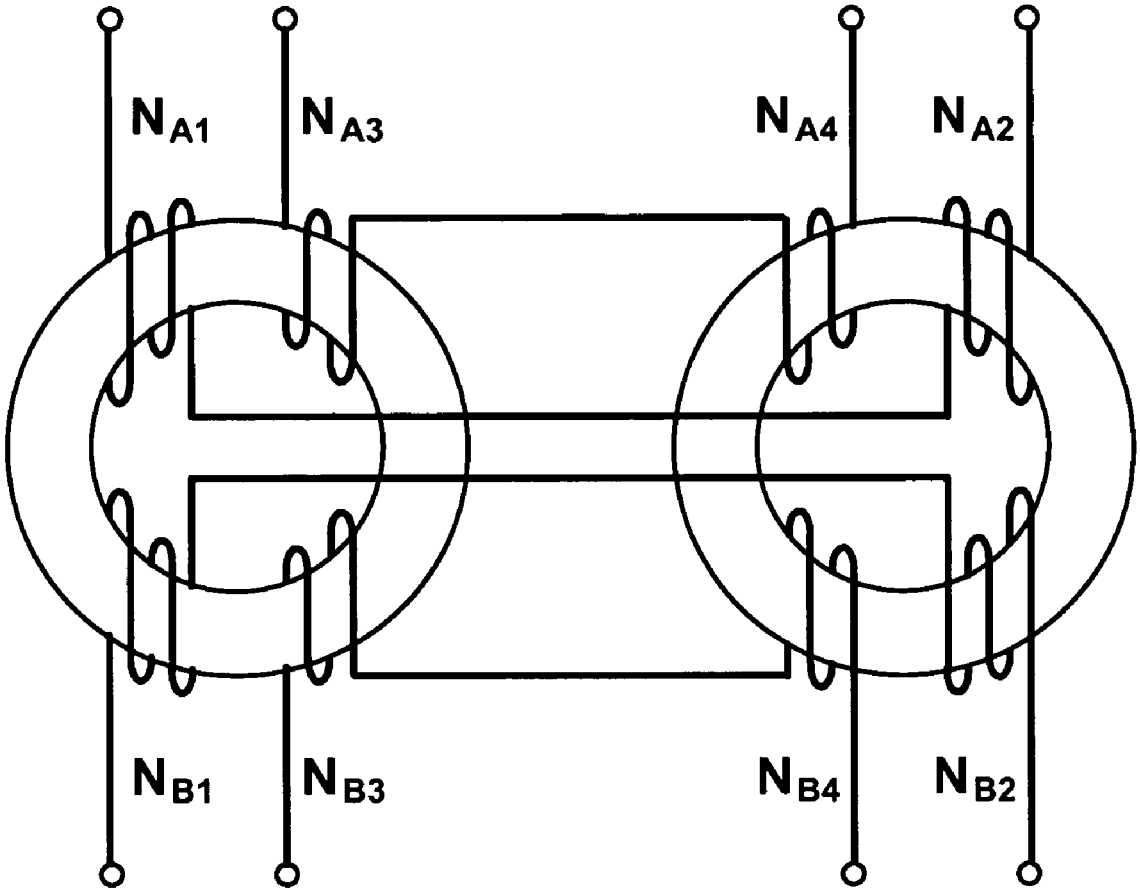
FIG. 10 shows a multi-port electromagnetic device having four serially coupled windings in accordance with the present invention.

FIG. 10 shows a multi-port electromagnetic device having four-windings in accordance with the present invention. The first winding, which consists of serial windings $N_{A1}$ and $N_{A2}$, and the second winding, which consists of serial windings $N_{A3}$ and $N_{A4}$, form a first group of windings for this embodiment. The first group functions as a first transformer having a first primary winding and a first secondary winding. The third winding, which consists of serial windings $N_{B1}$ and $N_{B2}$, and the fourth winding, which consists of serial windings $N_{B3}$ and $N_{B4}$, form a second group of windings. The second group functions as a second transformer having a second primary winding and a second secondary winding. For the reasons stated above, the first transformer and the second transformer are magnetically independent of each other, thereby allowing the device of FIG. 10 to be used in applications that require independent transformers.

Figure 11:
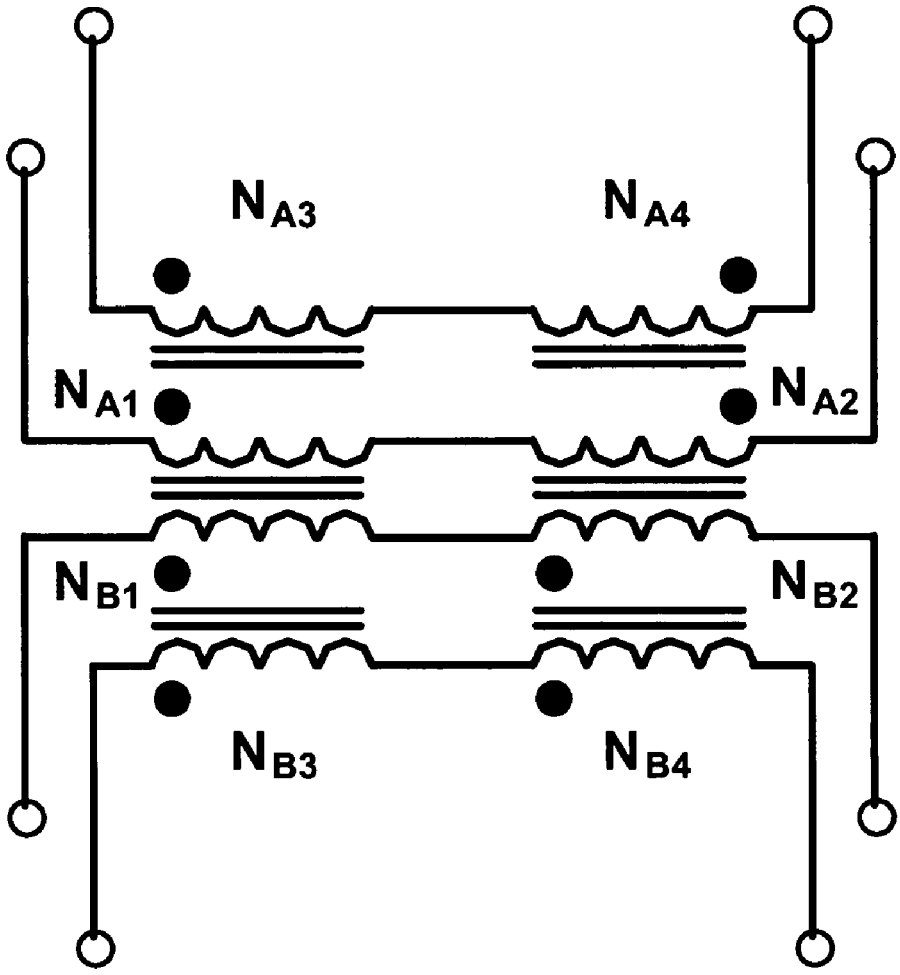
FIG. 11 shows the simplified symbol of the multi-port electromagnetic device of FIG. 10.
Figure 12:
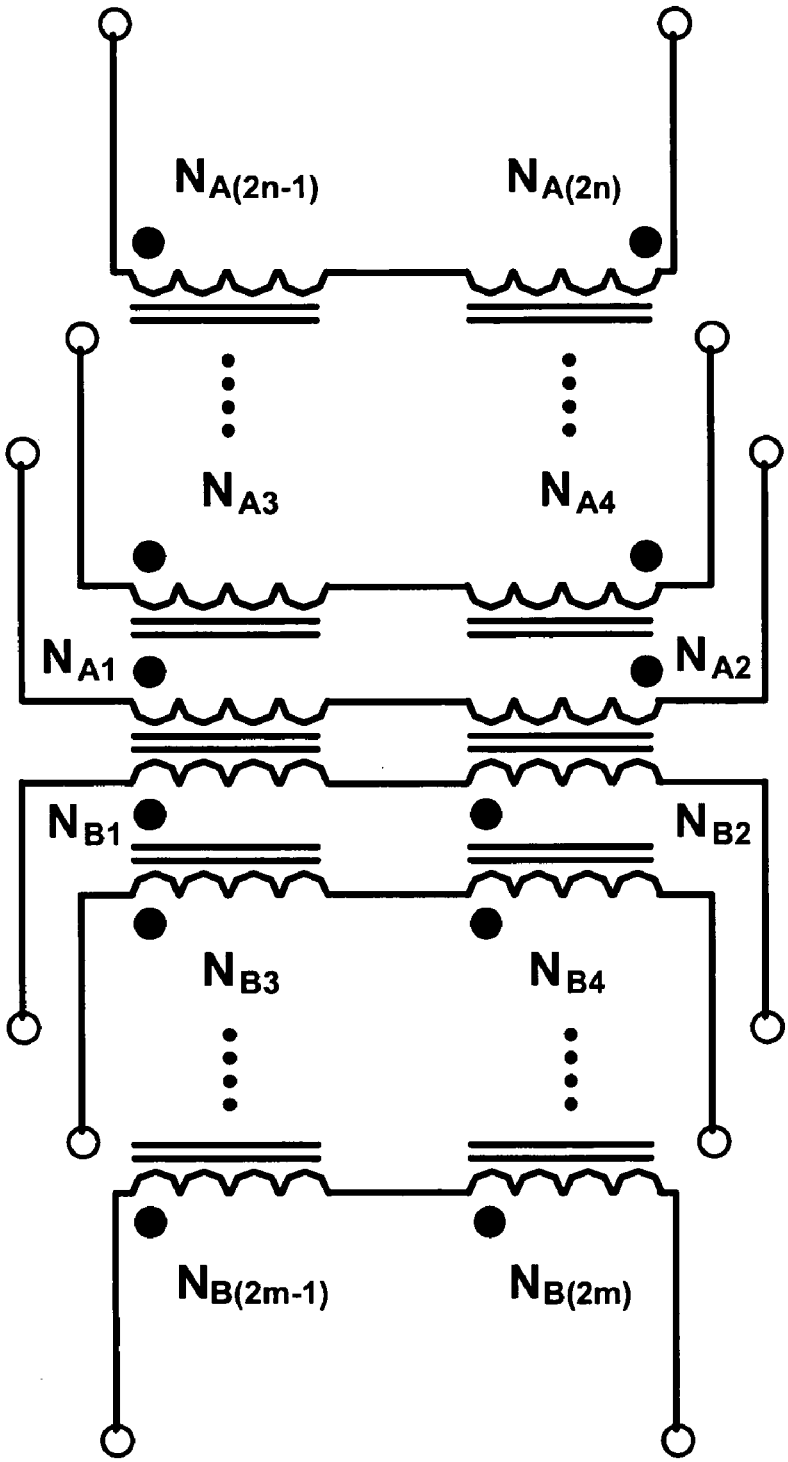
FIG. 12 shows the simplified symbol of a multi-port electromagnetic device having m+n serially coupled windings in accordance with the present invention.

FIG. 11 shows the simplified symbol of the integrated magnetic device of FIG. 10. FIG. 12 shows the simplified symbol of the multi-port electromagnetic device of FIG. 11 having m+n serial windings, where m and n can be any integers. The n number of windings in the first group functions as an n-winding transformer, while the m number of windings in the second group functions as another independent m-winding transformer. In an exemplary application, this embodiment of the invention can be used for providing a compact arrangement for multiple independent transformers in various applications that require independent transformers.

Figure 13:
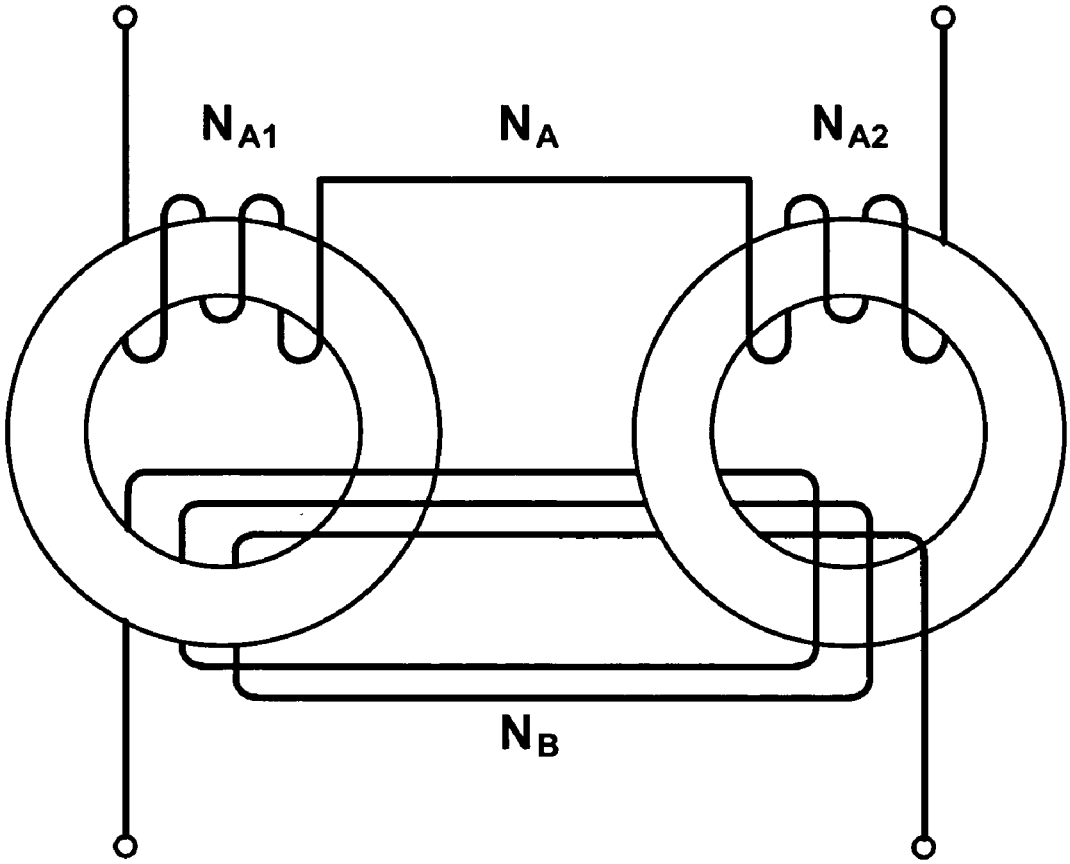
FIG. 13 shows a multi-port electromagnetic device having a serially coupled winding and a parallel winding according to yet another embodiment of the invention.

Another embodiment of the multi-port magnetic elements is shown in FIG. 13. This embodiment comprises a first winding $N_A$, a second winding $N_B$, and a first magnetic core and a second magnetic core. The first winding $N_A$ consists of series connected windings $N_{A1}$ and $N_{A2}$. However, the second winding $N_B$ is wound on the two magnetic cores in parallel (as opposed to series) as shown in FIG. 13. As can be seen, the winding $N_{A1}$ is wound on the first core in the same direction as the second winding $N_B$. However, the winding $N_{A2}$ is wound on the second core in the opposite direction of the second winding $N_B$ to provide for current cancellation as described above.

Figure 14:
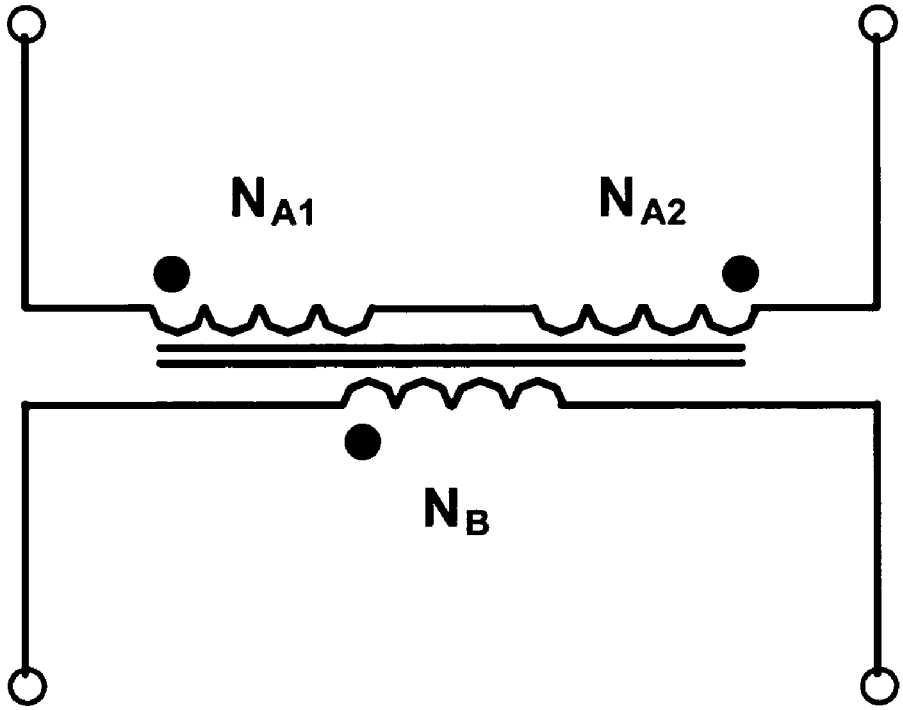
FIG. 14 shows the simplified symbol of the multi-port electromagnetic device of FIG. 13.
Figure 15:
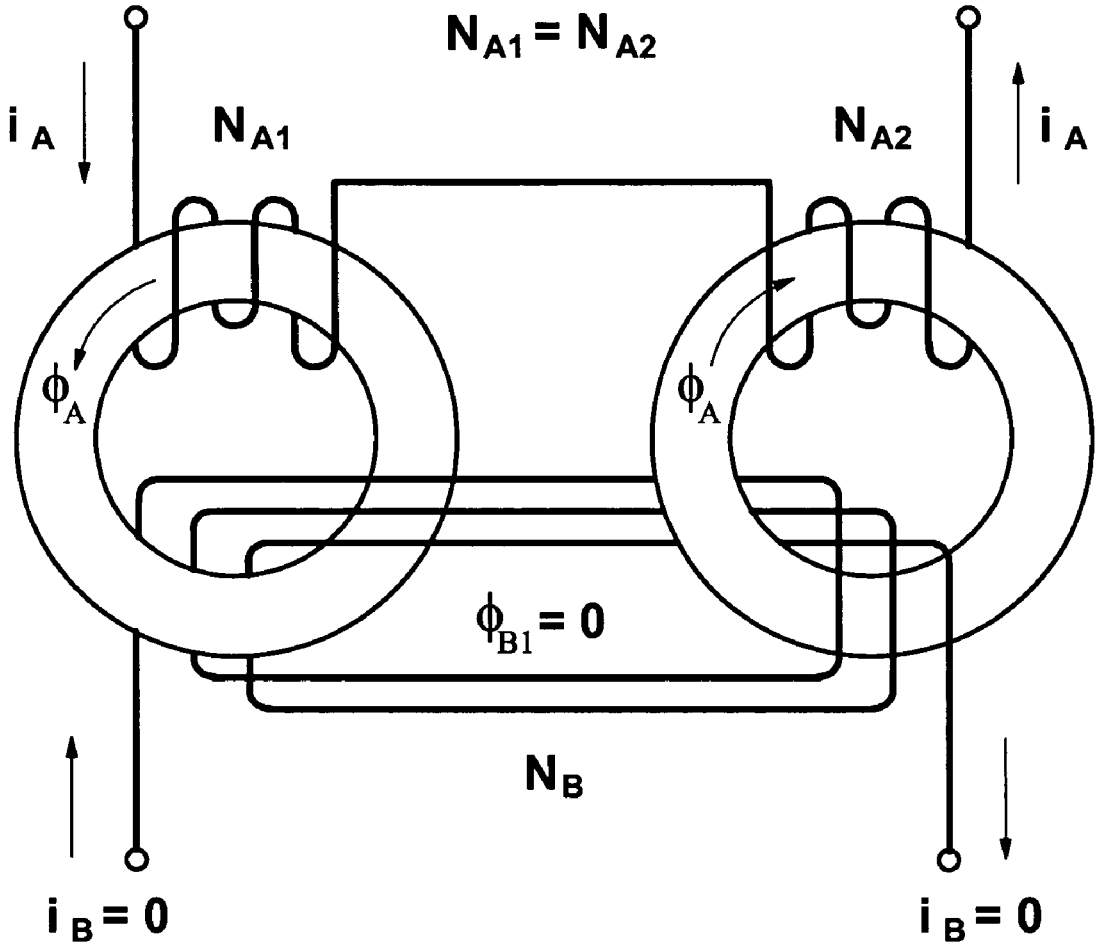
FIG. 15 shows the multi-port electromagnetic device of FIG. 13 with one reference directions for current and magnetic flux.

FIG. 14 shows the simplified symbol of the multi-port magnetic device of FIG. 13. Moreover, FIG. 15 shows the multi-port magnetic device of FIG. 13 with reference directions of currents and magnetic flux as current $i_A$ flows through serial winding $N_{A1}$ and $N_{A2}$. To make the windings magnetically independent of each other, the serial windings $N_{A1}$ and $N_{A2}$ have an equal number of turns, i.e., $N_{A1}=N_{A2}$. As can be seen in FIG. 15, current $i_A$ generates magnetic flux $\phi_A=N_A\times i_A$ in the first and second magnetic cores in opposite directions. Because of the flux directions, the overall flux encircled by the second winding $N_B$ is zero, and hence, the induced current is also zero, i.e., $i_B=0$, which makes the first winding $N_A$ and the second winding $N_B$ of this embodiment of the invention magnetically independent of each other.

Figure 16:
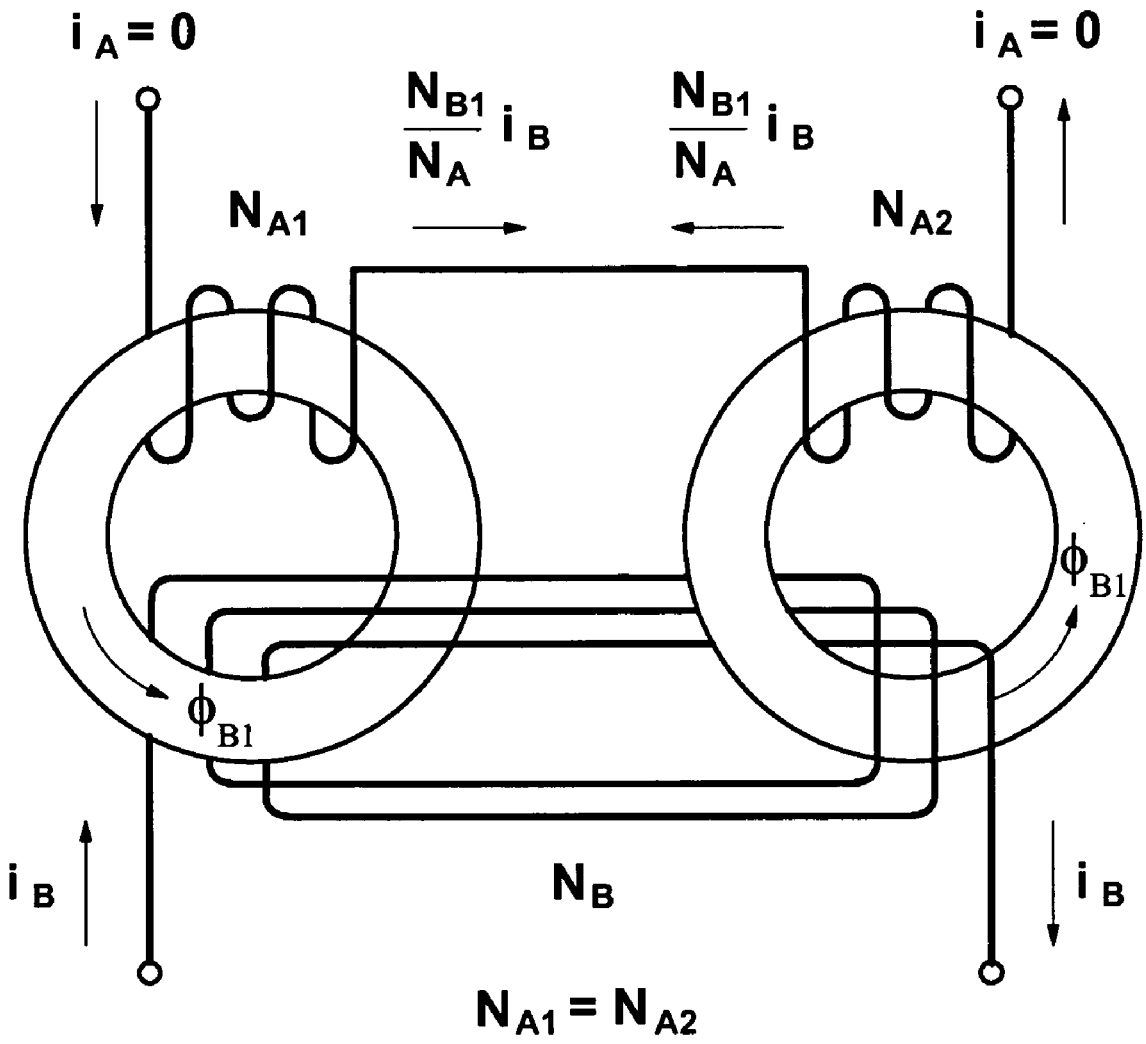
FIG. 16 shows the multi-port electromagnetic device of FIG. 13 with another reference directions for currents and magnetic flux.

FIG. 16 shows the multi-port magnetic device of FIG. 13 with reference directions of currents and magnetic flux as current $i_B$ flows through the second winding $N_B$. Current $i_B$ generates magnetic flux $\phi_{B1}=N_{B1}\times i_B$ in the first and second magnetic cores, which have equal magnetic characteristics. Flux $\phi_{B1}$ induces a current in the serial windings $N_{A1}$ and $N_{A2}$. Because of the winding directions and equal number of turns of the serial windings $N_{A1}$ and $N_{A2}$, the induced currents are opposite and cancel each other out causing the total current to be zero, i.e., $i_A=0$. Moreover, the induced voltage $V_{NA}$ across the first winding $N_A$ is not influenced by current $i_B$ in the second winding $N_B$ because the voltage $V_{NA}$ is proportional to the varying rate of the current $i_A$, which is zero. As a result, the first winding $N_A$ and the second winding $N_B$ are magnetically independent.

Figure 17:
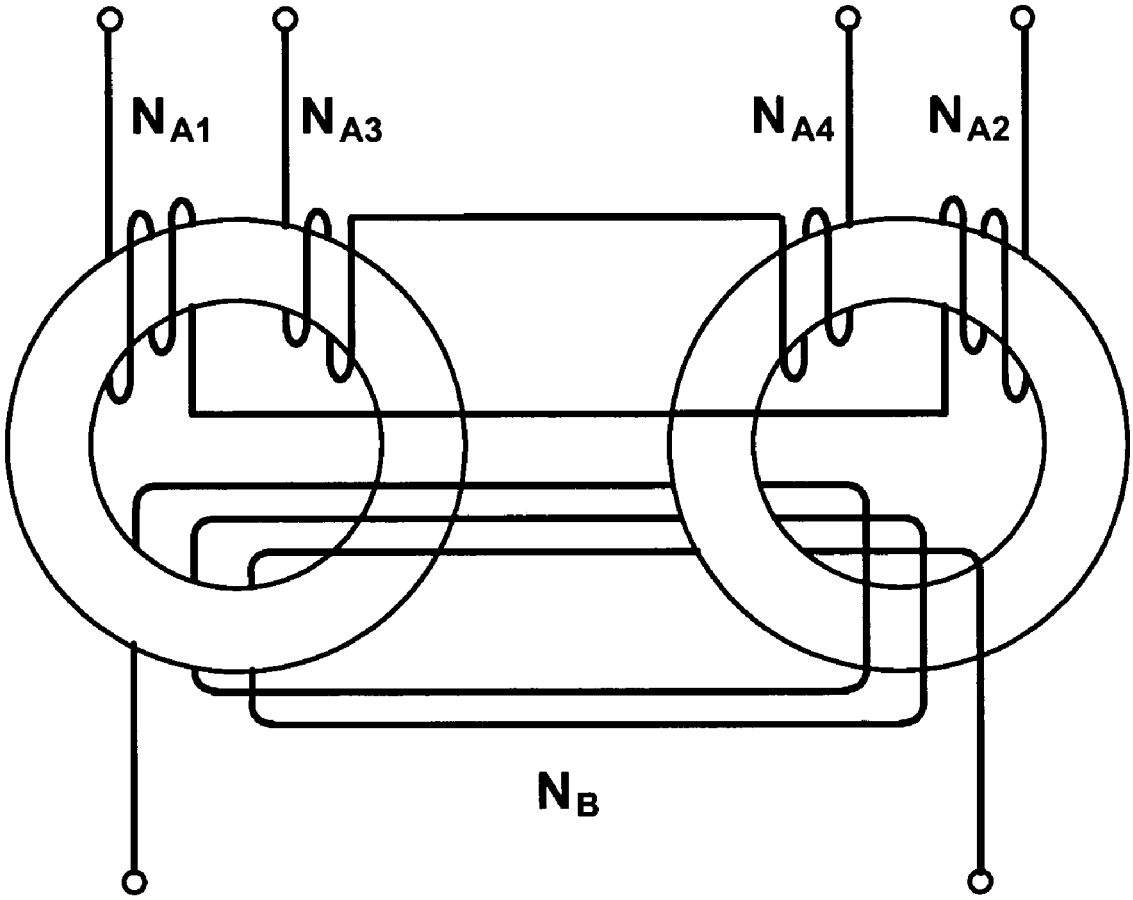
FIG. 17 shows a multi-port electromagnetic device having two serially coupled windings and one parallel winding.
Figure 18:
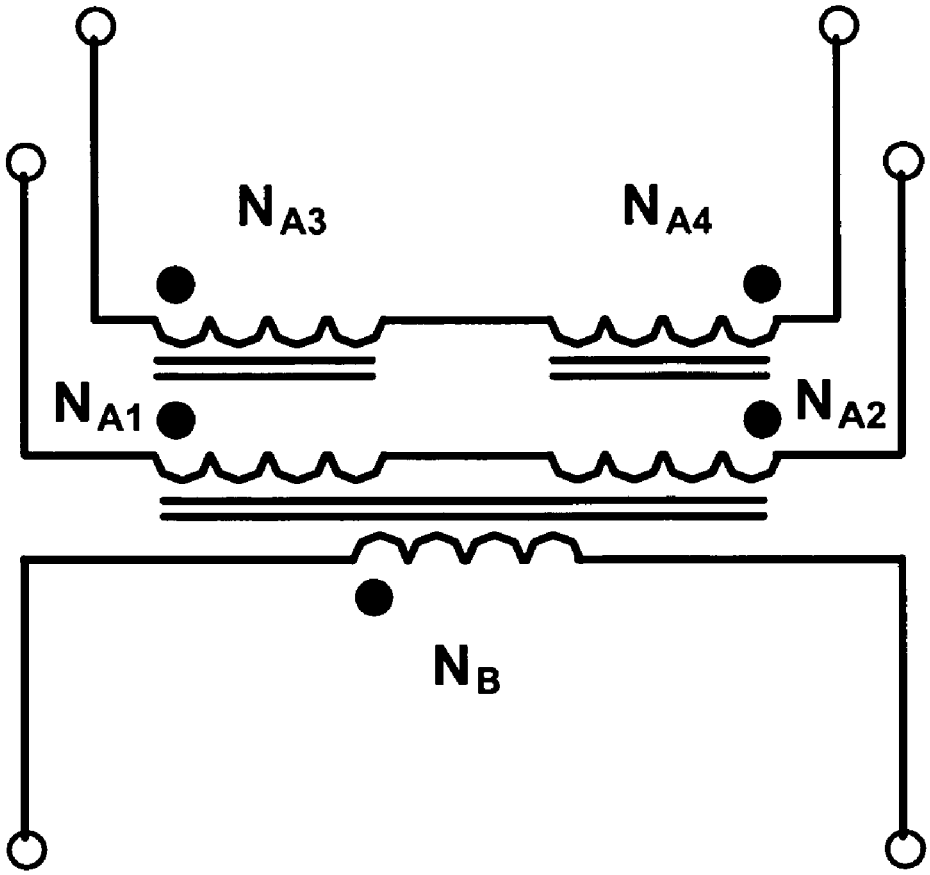
FIG. 18 shows the simplified symbol of the integrated magnetic device of FIG. 17.
Figure 19:
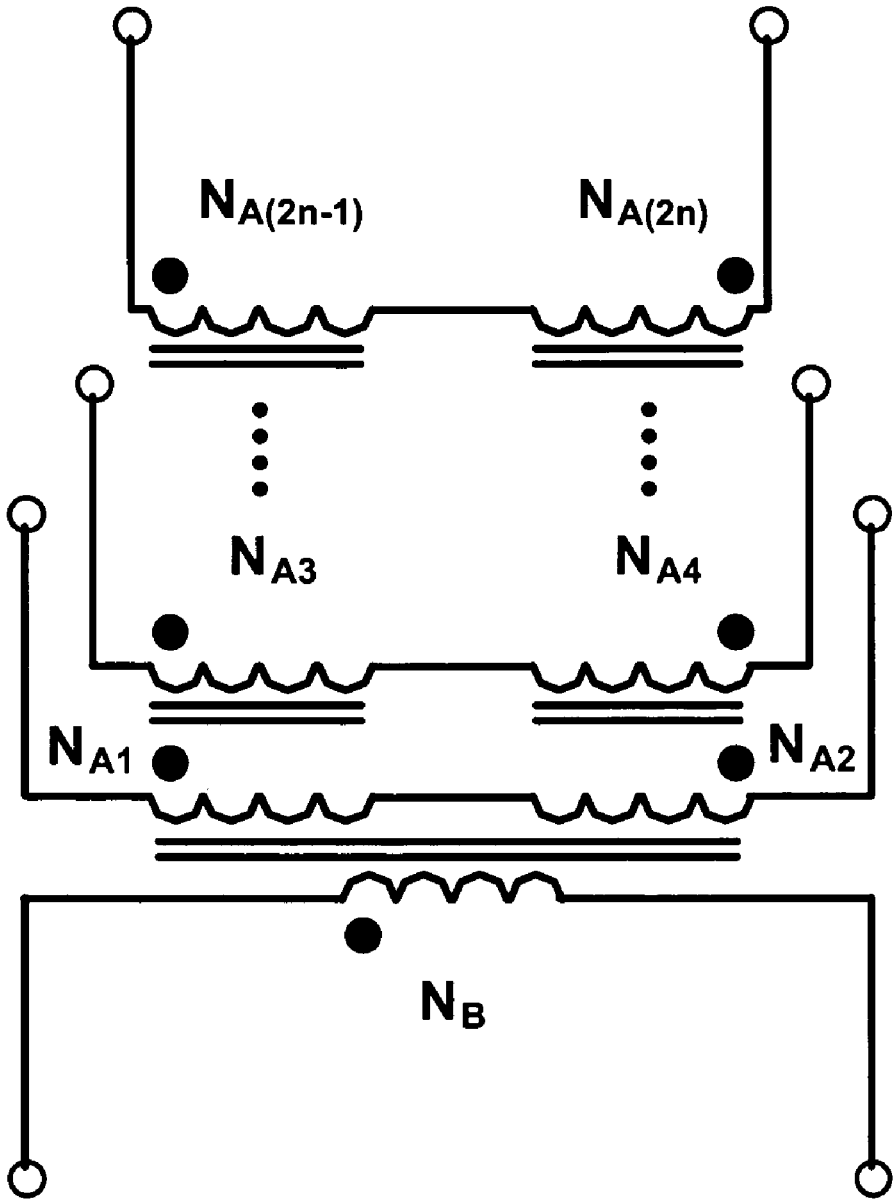
FIG. 19 shows the simplified symbol of a multi-port electromagnetic device according to an embodiment having n+1 windings.

FIG. 17 shows another embodiment of magnetic device of FIG. 13 with three windings. Moreover, FIG. 18 shows the simplified symbol of the multi-port magnetic device of FIG. 17 with the polarity marks of all the windings. The first winding, which consists of serial windings $N_{A1}$ and $N_{A2}$, and the second winding, which consists of serial windings $N_{A3}$ and $N_{A4}$ form a first group of windings. A third parallel winding $N_B$ forms a second group of winding by itself. The multiple windings in the first group function as a multiple-winding transformer and the single winding in the second group functions as an independent inductor. More specifically, the first and second windings in the first group function as a two-winding transformer, while the third winding functions as an independent inductor. FIG. 19 shows the simplified symbol of an n+1 winding multi-port magnetic device with the polarity marks of all the windings, where n is any integer, in accordance with this aspect of the present invention.

Figure 20:
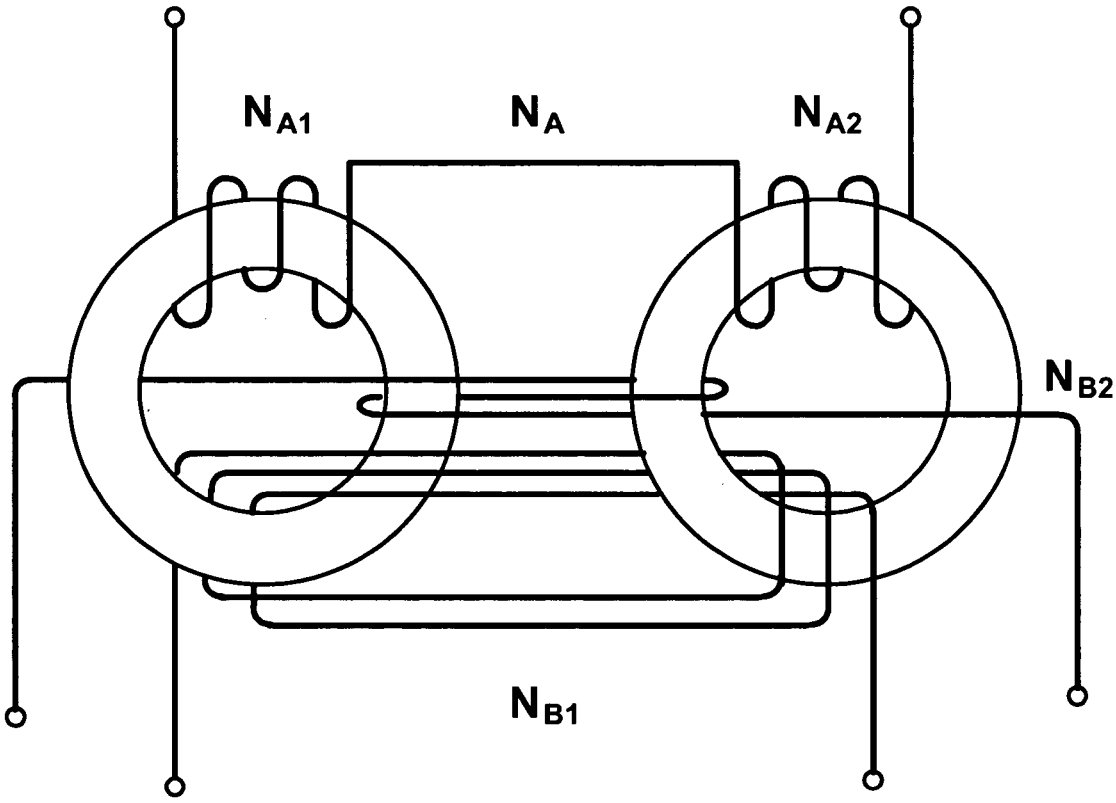
FIG. 20 shows a multi-port electromagnetic device according to an embodiment having two parallel and a serial windings.
Figure 21:
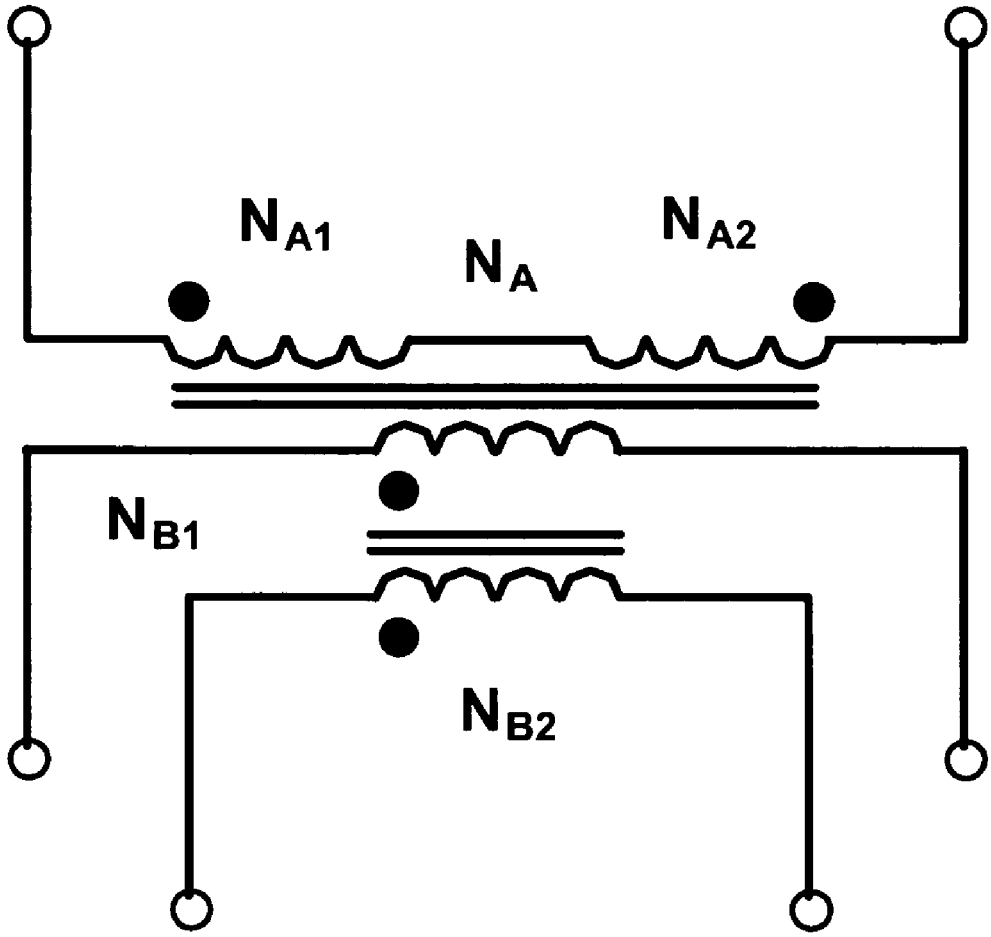
FIG. 21 shows the simplified symbol of the multi-port electromagnetic device of FIG. 20.
Figure 22:
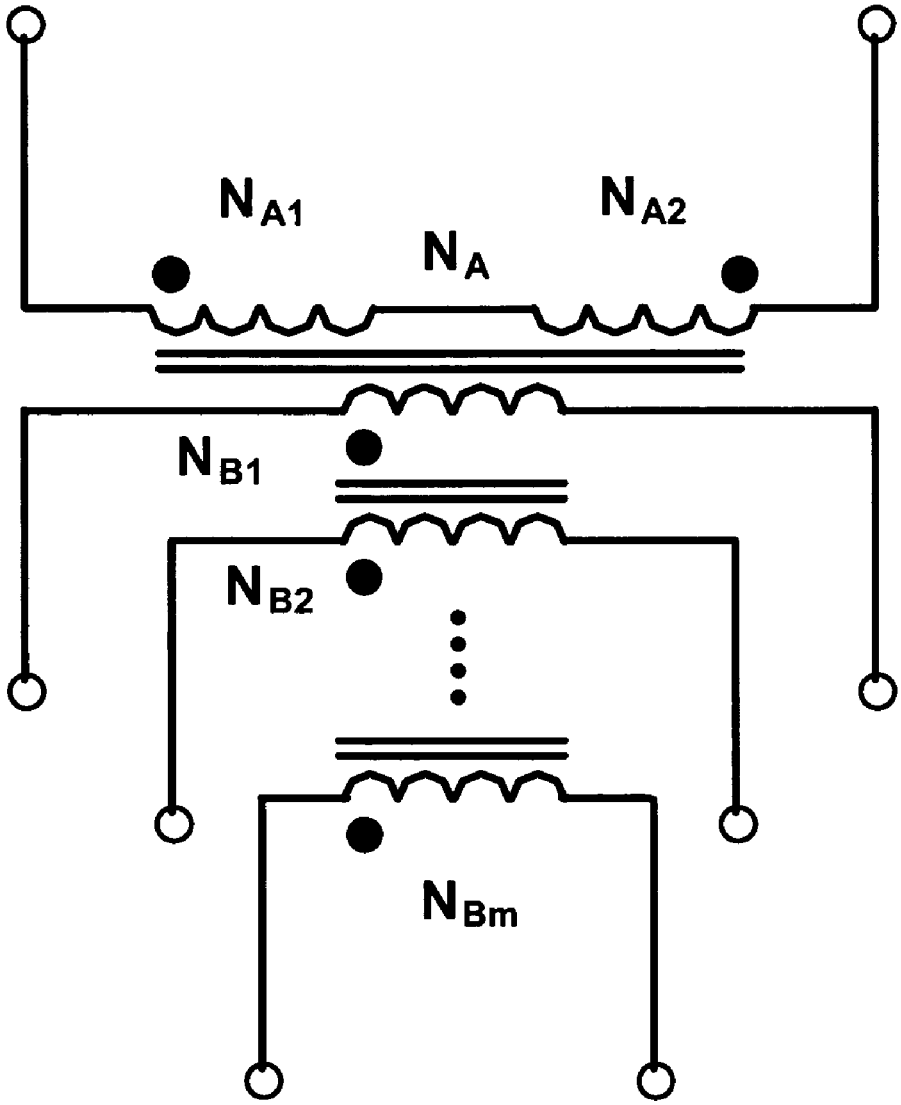
FIG. 22 shows the simplified symbol of a multi-port electromagnetic device according to an embodiment having m+1 windings.

FIG. 20 shows yet another embodiment of a multi-port magnetic device having three windings in accordance with the present invention. As shown, this embodiment includes a first winding $N_A$ having serial windings $N_{A1}$ and $N_{A2}$ which forms an inductor. A second parallel winding $N_{B1}$ and a third parallel winding $N_{B2}$, which form a transformer. FIG. 21 shows the simplified symbol of the integrated magnetic device in FIG. 20 with the polarity marks of all the windings. FIG. 22 shows another simplified symbol of the m+1 winding magnetic with the polarity marks of all the windings, where m is any integer.

Figure 23:
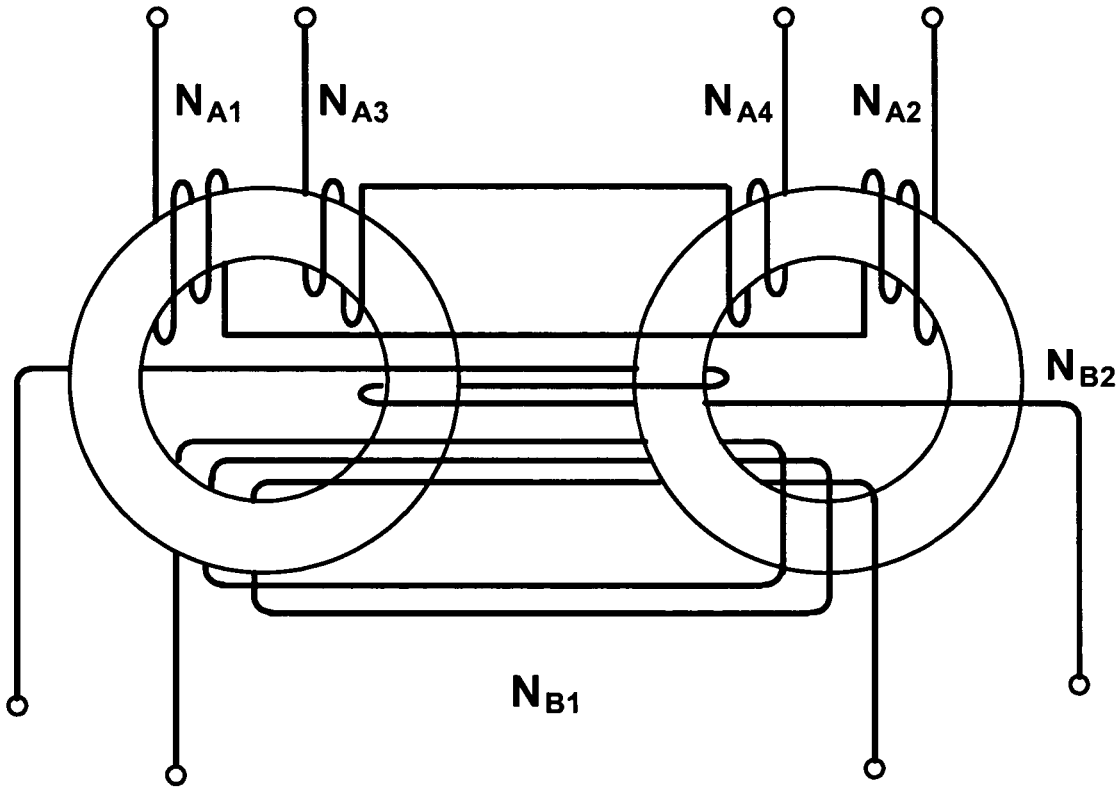
FIG. 23 shows another multi-port electromagnetic device according an embodiment having four-windings.
Figure 24:
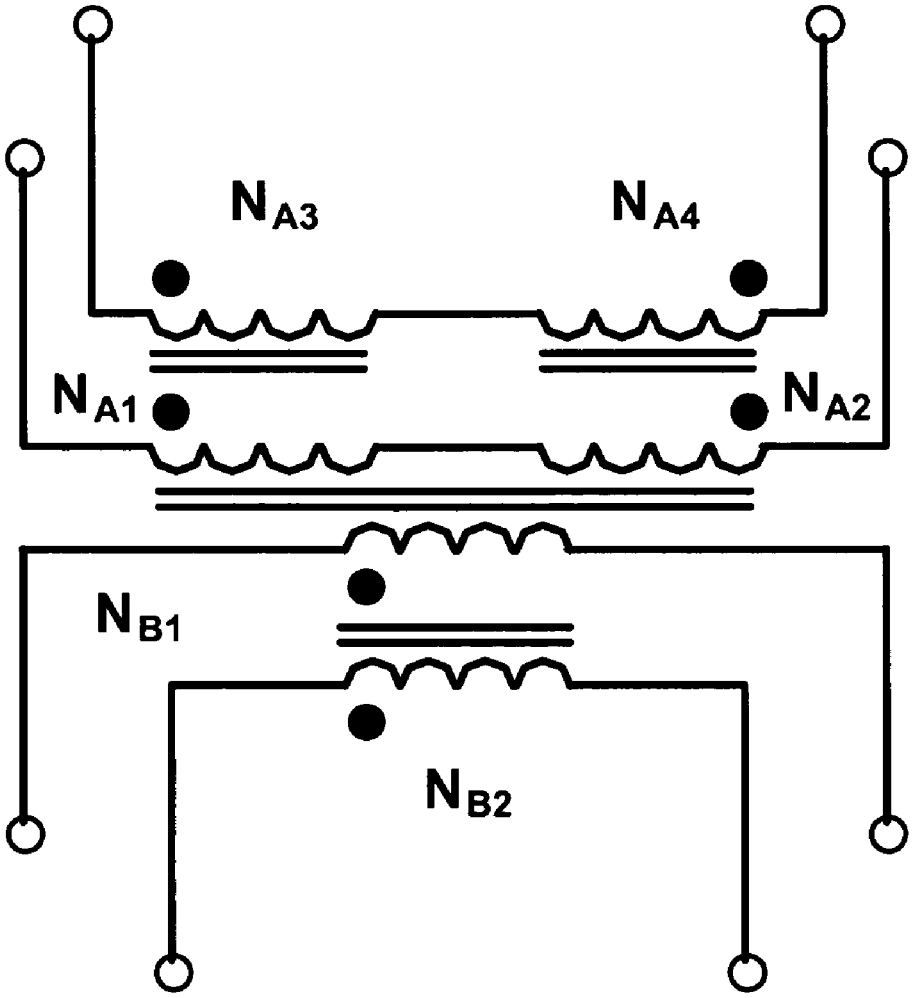
FIG. 24 shows the simplified symbol of the multi-port electromagnetic device of FIG. 23.
Figure 25:
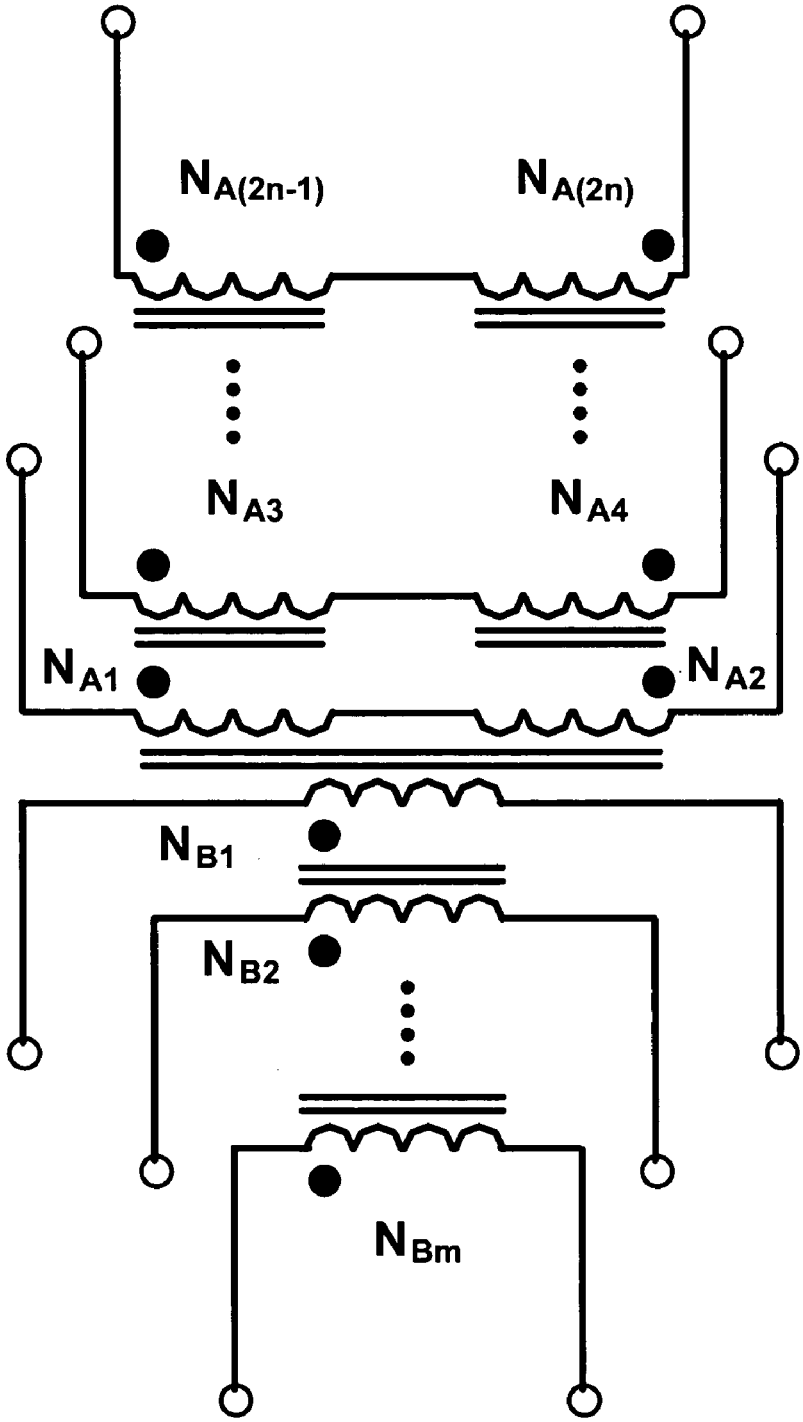
FIG. 25 shows another simplified symbol of still another multi-port electromagnetic device having m+n windings according to the present invention.

FIG. 23 shows still another embodiment of a multi-port magnetic device having four windings. The first winding, which consists of serial windings $N_{A1}$ and $N_{A2}$, and the second winding, which consists of serial windings $N_{A3}$ and $N_{A4}$, form a first group of windings that functions as a two-winding transformer. A third parallel winding $N_{B1}$ and a fourth parallel winding $N_{B2}$ form a second group of windings that functions as another two-winding transformer. The first transformer and the second transformer are magnetically independent. FIG. 25 shows the simplified symbol of a m+n winding multi-port magnetic device with the polarity marks of all the windings, where m and n are any integer.

Figure 26:
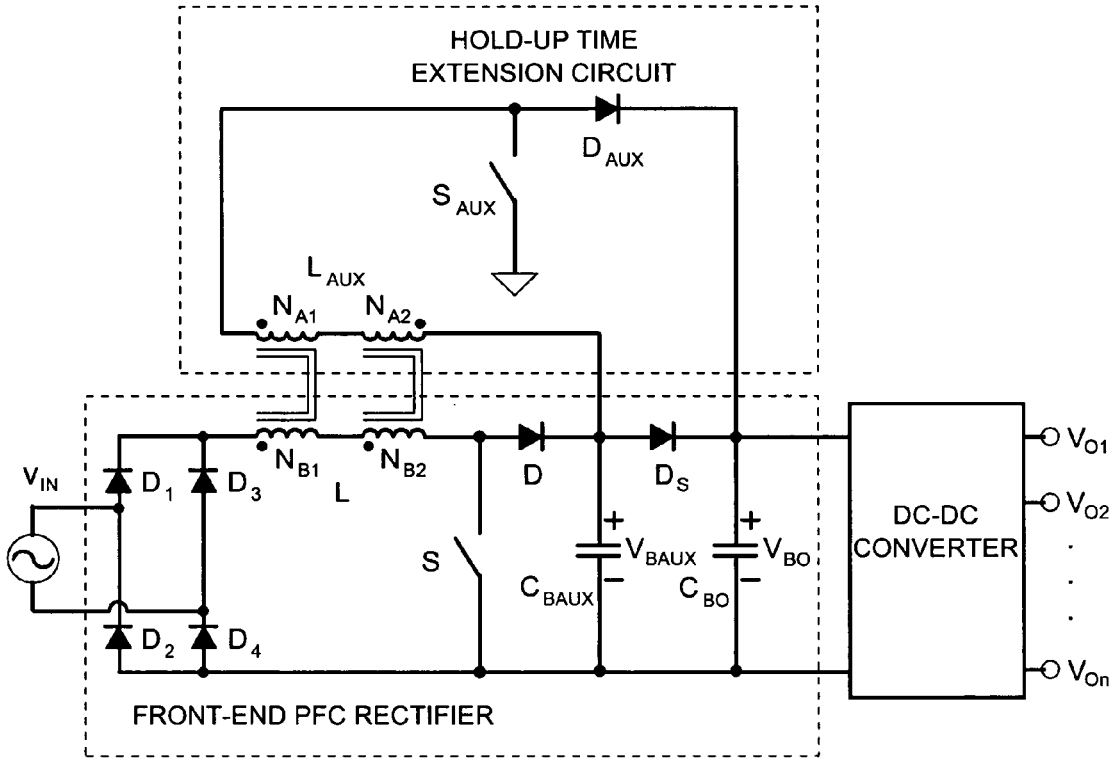
FIG. 26 shows a hold-up time extension circuit and front-end PFC rectifier, which use the multi-port electromagnetic device of FIG. 3.

FIG. 26 shows a hold-up time circuit and front-end PFC rectifier using the multi-port magnetic device shown in FIG. 3. By using the proposed technique, the two separate boost inductors of the PFC front-end rectifier and the hold-up time extension circuit can be integrated.

Figure 27:
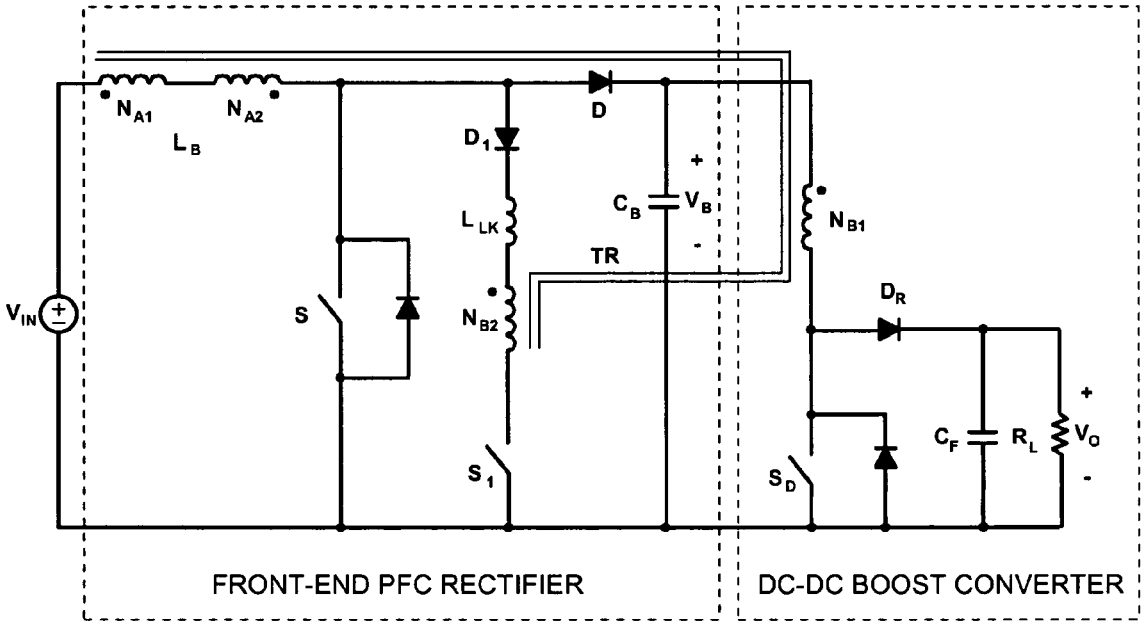
FIG. 27 shows a soft-switched front-end PFC rectifier and dc—dc boost converter, which use the multi-port electromagnetic device of FIG. 20.

FIG. 27 shows another application of the invention, which uses the multi-port magnetic device of FIG. 20 in a soft-switched front-end PFC rectifier and dc—dc boost converter.

Figure 28:
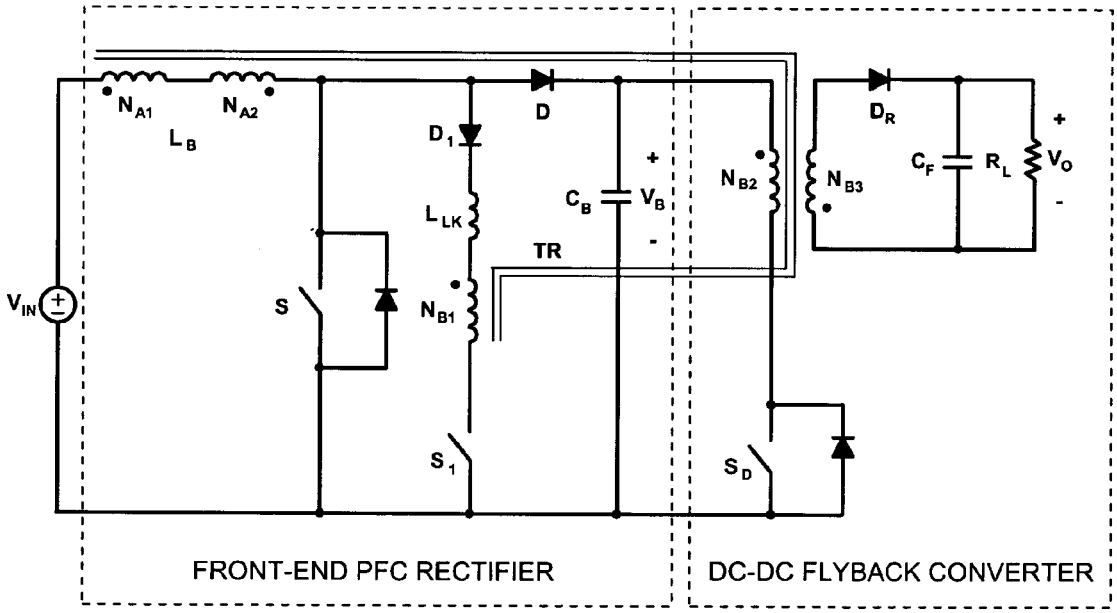
FIG. 28 shows a soft-switched front-end PFC rectifier and dc—dc flyback converter, which use the multi-port electromagnetic device of FIG. 22, where the integer m is 3.

Finally, FIG. 28 shows a soft-switched front-end PFC rectifier and dc—dc flyback converter, which uses the multi-port magnetic device of FIG. 22, where the integer m is 3.

The invention claimed is:

1. A multi-port electromagnetic device, comprising:

a first magnetic core having a first closed flux path;

a second magnetic core having a second closed flux path, said first closed flux path being independent from the second closed flux path;

at least one first winding that electromagnetically couples the first magnetic core to the second magnetic core;

at least one second winding that electromagnetically couples the first magnetic core to the second magnetic core independent of the electromagnetic coupling of the at least one first winding such that current application in one of the first or second windings does not induce a magnetic flux in the other one of the first or second windings at least one third winding that electromagnetically couples the first magnetic core to the second magnetic core, said at least one third winding being electromagnetically coupled to the at least one first winding; and at least one fourth winding that electromagnetically couples the first magnetic core to the second magnetic core, said at least one fourth winding being electromagnetically coupled to the at least one second winding.

2. An electromagnetic device, comprising:

a first magnetic core having a first closed magnetic flux path;

a second magnetic core having a second closed magnetic flux path, said first closed magnetic flux path being decoupled from the second closed magnetic flux path;

a first transformer comprising a first primary winding and a first secondary winding; said first primary and said first secondary windings electromagnetically coupling the first magnetic core to the second magnetic core; and a second transformer that is electromagnetically independent of the first transformer comprising a second primary winding and a second secondary winding, said second primary and second secondary windings electromagnetically coupling the first magnetic core to the second magnetic core.

3. A power supply, comprising:

a hold-up time circuit;

a front-end PFC rectifier;

a multi-port electromagnetic device that couples the hold-up time circuit to the font-end PFC rectifier, comprising:

a first magnetic core having a first closed flux path;

a second magnetic core having a second closed flux path, said first closed flux path being independent from the second closed flux path;

at least one first winding that electromagnetically couples the first magnetic core to the second magnetic core;

at least one second winding that electromagnetically couples the first magnetic core to the second magnetic core independent of the electromagnetic coupling of the at least one first winding such that current application in one of the first or second windings does not induce a magnetic flux in the other one of the first or second windings.

4. The power supply of claim 3, wherein the first winding comprises an inductor of the hold-up time circuit and the second winding comprises an inductor of the front-end PFC rectifier.

* * * * *